United States Patent [19]

Pressler

[11] Patent Number: 4,923,217

[45] Date of Patent: May 8, 1990

[54] FILE CONVERTER ASSEMBLY

[75] Inventor: Philip B. Pressler, Wayne, Pa.

[73] Assignee: PNS Associates, Inc., Southeastern, Pa.

[21] Appl. No.: 243,070

[22] Filed: Sep. 9, 1988

[51] Int. Cl.[5] ..... B42D 15/00

[52] U.S. Cl. ..... 283/62; 283/81; 283/117

[58] Field of Search ..... 281/15.1, 51, 38; 283/81, 62, 117

[56] References Cited

U.S. PATENT DOCUMENTS

| | | | |
|---|---|---|---|
| 1,868,188 | 7/1922 | Barker . | |
| 2,052,623 | 9/1936 | Harby | 93/1 |
| 3,245,162 | 4/1966 | McElroy | 40/23 |
| 3,691,662 | 9/1972 | Cunningham | 40/23 A |
| 3,747,242 | 7/1973 | Heimann | 40/23 A |
| 3,805,426 | 4/1974 | Cunningham | 40/125 A |
| 3,937,493 | 2/1976 | Fasbender | 283/41 |
| 3,962,807 | 6/1976 | Pantone | 40/78.15 |
| 4,201,403 | 5/1980 | Turner | 283/21 |
| 4,204,639 | 5/1980 | Barber | 235/462 |
| 4,240,848 | 12/1980 | Barber | 156/64 |
| 4,329,191 | 5/1982 | Barber | 156/65 |
| 4,445,711 | 5/1984 | Cunningham | 283/1 R |
| 4,523,776 | 6/1985 | Barber | 283/39 |
| 4,544,182 | 10/1985 | Spring | 283/81 |
| 4,580,815 | 4/1986 | Barber | 283/81 |

FOREIGN PATENT DOCUMENTS

| | | | |
|---|---|---|---|
| 934261 | 9/1973 | Canada | 283/81 |
| 0001167 | 7/1979 | European Pat. Off. . | |
| 891985 | 10/1953 | Fed. Rep. of Germany . | |
| 1289515 | 2/1969 | Fed. Rep. of Germany | 40/23 A |
| 1239365 | 7/1960 | France . | |
| 141053 | 9/1930 | Switzerland . | |

*Primary Examiner*—Paul A. Bell

*Attorney, Agent, or Firm*—Dann, Dorfman, Herrell and Skillman

[57] ABSTRACT

A conversion tab assembly for conversion of a top-index file to a side-index file, consisting of a base sheet having a tab portion at one end of the sheet, an adhesive to mount the tab assembly to the top-index file, the tab being adjacent to one side edge of the file, and the primary sheet having a strength and stiffness to enable the side-index file to be displaced using the tab, and a flap foldable along one border of the base sheet to permit the sandwiching of a panel of the file between the base sheet and the flap securely using bonding materials, thereby reinforcing the file.

16 Claims, 1 Drawing Sheet

FIG.1
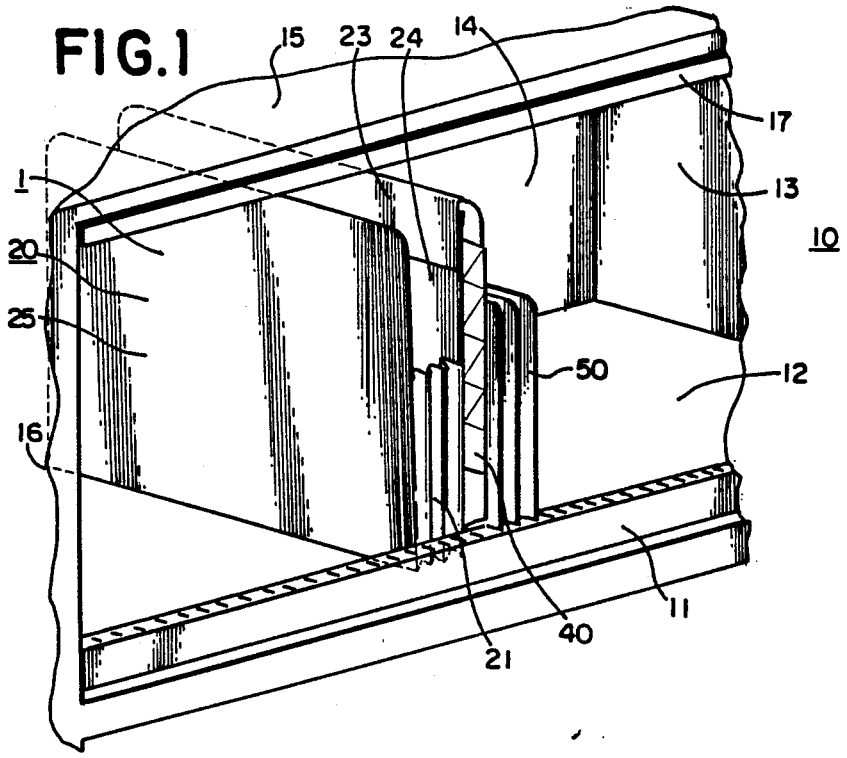
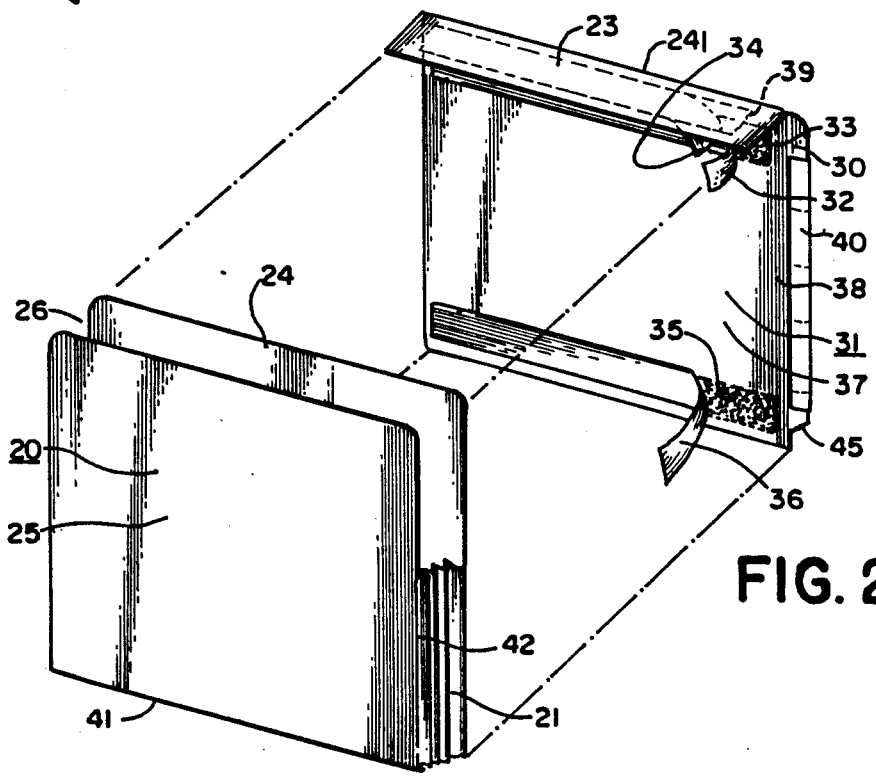
FIG. 2

FILE CONVERTER ASSEMBLY

FIELD OF THE INVENTION

The invention relates to index files of the type which are used for the storage of office records and articles. In particular, the invention relates to a conversion tab assembly for application to a top-index file to convert it to a side-index file.

BACKGROUND OF THE INVENTION

For the storage of office records and other articles, it is common practice to use a file system to facilitate the organization and storage of office records and articles. These file systems commonly take the form of a file having a front panel and a rear panel connected along at least one edge, and a top-index unit joined with one of the panels and having an index tab extending above the file to facilitate identification of the contents of the file. Such files are designed to be stored in file drawers for ready access. File drawers are space-consuming and both active and less active files are frequently transferred to shelf-storage units which may be fixed-shelf cabinets or power-driven moving shelves.

However, a file system with a top-index is cumbersome to remove from a horizontal storage shelf or like other storage apparatus since the file is difficult to grasp and manipulate when it is wedged between other files in a densely packed, narrow space, as is commonly done in the storage of files, and is therefore difficult to remove from the storage shelf.

In addition, it is difficult to read the label on the index tab of a top-index type file which is stored horizontally on a shelf since the files are generally positioned at a considerable depth within the shelf and the top index tabs are generally located at a mid-section of each file where the tops of the files are obscured.

Many offices initially use top-index files for storage, but use a horizontal-type storage shelf to store these files when it becomes necessary or desirable to conserve space. Because of the difficulty involved in reading the labels of top-index files stored on storage shelves, the use of such files becomes impractical for the storage needs of many offices.

Some offices convert a top-index file to a side-index file by attaching a tab to one side of the index file to facilitate ease to the user in reading and organizing the labels when the file is stored horizontally on a shelf. However, these tabs cannot extend along the full height of the file, lack durability and may be torn off, or are difficult to grasp to afford removal of the file from a densely packed storage shelf.

Side-index file folders and envelopes are available for receiving the contents of the top-index files, and such files may be grasped by their exposed edge for removal from a storage shelf. However, such envelope files are expensive and frequently spillage and disorder of the file contents occur when the contents of a heavy top-index file are transferred to the side-index file. Furthermore, notes or documents placed in the file may be lost or misplaced in the transfer. The index edge of the envelope is often difficult to see, and they are not designed to accommodate thick documents or bulky articles.

SUMMARY OF THE INVENTION

In an attempt to overcome these problems, the conversion tab assembly of the present invention has been designed to facilitate the conversion of a top-index file to a side-index file and consists of a primary or base sheet having a tab at one end and a flap along another edge and an adhesive material on the flap and the sheet to securely mount the conversion tab assembly to the file by sandwiching a panel element of the file between the sheet and the flap, the tab having a strength and stiffness to enable the side-index file to be removed from a horizontal-type storage shelf using the tab.

The present invention provides a conversion tab assembly which enables the use of a strong and stiff sheet of material having a side-index tab attached at one end which, when affixed to a top-index file, converts that file into a side-index file and thereby provides ease in the storage, organization and retrieval of top-index files which are to be stored on horizontal-type storage shelves.

In addition, the present invention provides a simple and efficient method of converting top-index files into side-index files and provides a quick method of utilizing existing top-index files for efficient use with a different storage facility such as a shelf, avoiding the expense and burden of purchasing new side index files, emptying the contents of the old files and placing the contents in the new side-index files.

Furthermore, the present invention provides a reliable and efficient method of removing side-index files from a horizontal storage shelf by providing a reinforced tab at one end of the file which may be grasped for the removal of the file by the user.

The present invention additionally provides an easy method of identifying and organizing files stored on horizontal storage shelves by providing a tab at one end of the file which extends beyond the edge of the file and may extend the full height of the file for facile identification of the file contents.

The present invention provides a conversion tab assembly to convert a top-index file to a side-index file to facilitate the efficient storage and retrieval of top-index files housed on horizontal storage shelves and comprises a base sheet of material having a tab at one edge, a flap portion attached to the base sheet at another edge of the sheet to sandwich an element or panel of the file between the sheet and the file to reinforce the file and adhesive strip means applied to the flap and the sheet to securely mount the conversion tab assembly to the top-index file.

The preferred embodiment of the invention includes a conversion tab assembly for the conversion of a top-index file to a side-index file to facilitate ease in the storage and retrieval of top-index files from horizontal storage shelves and comprises a strong and stiff sheet of material having a tab formed at one side edge, a flap attached to the sheet along an upper edge and an adhesive material applied to the flap and the sheet in strips along both the upper and lower edges of the sheet, such that, upon sandwiching of a panel element of the index file between the sheet and the flap, the conversion tab assembly may be securely mounted to the top-index file to reinforce the file, the tab assembly being suitably positioned relative to the file to permit the tab to extend beyond one side edge of the file for the full height of the file.

BRIEF DESCRIPTION OF THE DRAWINGS

The foregoing summary, as well as the following detailed description of a preferred embodiment of the present invention, will be better understood when read in conjunction with the appended drawings, in which:

FIG. 1 is a perspective view of a horizontal storage shelf storing a conversion tab assembly mounted to a top-index file in accordance with the present invention; and FIG. 2 is an enlarged exploded perspective view of the conversion tab assembly showing the manner in which the tab assembly may be secured to a top-index file to convert it to a side-index file.

DESCRIPTION OF THE PREFERRED EMBODIMENT

Referring now to the drawings, and in particular to FIGS. 1–2, there is shown generally a conversion tab assembly for application to a top-index file to convert it to a side-index file. The apparatus comprises a primary or base sheet 37 which has a tab 30 along one end 38 of the sheet and adhesive materials 33 and 35 to mount the sheet to a surface, e.g., the rear panel 24, of the top-index file 20, so that the tab 30 projects beyond the end of the file 20. A flap 23 is provided along another edge 241 of the primary sheet 37 to permit sandwiching of rear panel 24 of file 20 between the primary sheet and the flap 23, both to firmly anchor the sheet 37 to the panel and to reinforce the file, the primary sheet 37 having a strength and stiffness to enable the side-index file assembly to be removed from the shelf 10 using the tab 30.

Referring now to FIG. 1, the storage shelf structure 10 includes a housing 15 and a lower rectangular surface or support plate 12 having side rectangular surfaces 13 disposed perpendicularly to the upper and lower surfaces, the upper and lower surfaces being generally parallel to one another. In addition, the storage structure has a rear surface 14 disposed perpendicularly to the upper, lower and side surfaces and serves as a back rest for the storage of files in the storage structure 10 and prevents the files from falling from the rear of the storage shelf and may support shelf dividers 50 which may be used to partition the storage shelf. The illustrated storage shelf structure 10 also includes a vertical stop ledge 11 to anchor shelf dividers 50 in proper position and prevent inadvertent forward displacement of stored files through the front opening of the storage shelf structure. In addition, the illustrated storage shelf structure 10 includes a door 17 which, when extended, folds down over the front opening of the storage shelf to cover and protect the files deposited in the storage space defined between the ledge 11 and the back wall 14.

Referring now to FIGS. 1–2, the side-index file and tab converter assembly is shown applied to an accordion-type expandible file pocket 20 which has a front panel 25 and a rear panel 24, the front and rear panels being joined together by a gusset 21 on three corresponding sides of the front and rear panels, the edges along the upper sides of the panels being free, leaving a receptacle 26 for receiving articles such as office records which comprise the file contents. The gusset 21 is formed of, for example, cardboard stock or hinge cloth folded in segments like an accordion to enable expansion of the file and maximize the storage capacity of the file.

The conversion tab assembly 31 comprises the base sheet 37 having the flap 23 attached along the upper edge and the tab portion 30 attached at one side of the sheet.

In the illustrated embodiment of the present invention, the conversion tab assembly 31 is one sheet of material such as manila paper, having various sections cut out or scored to form the flap 23 and the tab 30 (shown in FIG. 2) extending beyond the base rectangular sheet 37. The flap 23 may be folded along a score line 241 which forms the top edge of the assembly.

Means is provided to mount the assembly 31 to the file 20. The flap 23 has an adhesive strip 39 applied along the full length of the flap. In the present instance, the adhesive is a continuous line of pressure-sensitive adhesive which may be exposed upon peeling back a cover strip 34. The adhesive on the flap is applied to the under surface of the flap 23 so that the flap may be folded over rear panel 24 of the file 20 enabling the adhesive to adhere to panel 24. The adhesive strip may be a separate two-sided adhesive strip, tape or the like which is affixed to the flap as the assembly is manufactured. Mucilage or other forms of bonding material may be used where pressure-sensitive adhesives are not desired.

The base sheet 37 similarly has bonding strips 33 and 35 along the upper and lower edges, and having cover strips 32 and 36, which may be peeled to expose the adhesive material 33 and 35 and permit affixation of the base sheet 37 to the rear panel 24. Folding the flap 23 over rear panel 24 and affixing thereto by the strip 39 reinforces this secure fit and also serves to reinforce the rear panel of the file. This added strength and reinforcement facilitates the removal of the file. Once the adhesive on the flap and the adhesive strips on the sheet are securely in contact with the rear panel of the folder, the mounting of the conversion tab assembly to the file and the conversion of the top-index file to a side-index file has been completed. The bonding strips 33 and 35 may also be comprised of two-sided adhesive tape, or other bonding material applied to the sheet 37.

The tab 30 is formed along one edge of the base sheet 37, in the preferred embodiment at the end of the sheet so it may project beyond the end of the rear panel of the file 20. At its lower end, the tab is notched as shown at 45 so that the bottom of the file 20 may abut the stop ledge 11, while the tab extends outwardly above the ledge, and may be easily seen. In the present instance, the tab 30 has labels 40 attached to it for the purpose of providing indicia for identification or labeling of the file contents. The labels may be color-coded or preprinted, as desired to identify the file contents. Alternatively, it may be desired to imprint suitable coding or other indicia directly on the tab 30.

The tab 30 and the sheet 31 are constructed of a material having a selected strength and stiffness to enable the index file, when loaded with articles, to be displaced without damage to the tab or sheet. To accomplish this, for example, the tab 30, the sheet 37 and the flap 23 may be reinforced with a flexible transparent polyester film, such as Mylar, or other durable material. If desired, the flap 23 may be composed completely of a durable polyester film such as Mylar and may be bonded to the top portion of the sheet 37.

Once the conversion tab assembly has been mounted to the file, the complete tab and file assembly may be positioned within the storage shelf structure 10 for storage and use as shown in FIG. 1. To remove the side-index file 1 from the storage structure 10, the user may grasp the tab 30, lift the corresponding end of the side-index file upward using the tab so that the bottom edge 41 of the file clears the ledge 11, enabling the sliding displacement of the file horizontally by pulling on the tab 30 causing the file to slide over the ledge 11 and thereby enabling the removal of the file from the storage space. The sandwiching of the upper marginal portion of the rear panel 24 between the flap 23 and the body of the sheet 37 serves to reinforce the converter assembly to reduce the tendency of the sheet 37 to tear. Preferably, the bonding strips 33 and 39 are equally spaced from the score line 241 to assure cohesion of the three-layer structure formed by the flap 23, the panel 24 and the base sheet 37.

Upon mounting of the conversion tab assembly 31 to the file 20, the adhesive materials on the flap and the sheet should be affixed to the rear panel 24 of the file in such a way that the sheet 37 is registered with the rear panel 24 such that the tab 30 extends beyond the side edge of the rear panel 24, thereby exposing the labels 40 or other indicia on the tab 30.

The conversion tab assembly is particularly adapted for use with shelf file structures having file openings with limited vertical clearance between the floor panel 12 and the cover element 17. To this end, the vertical dimension of the base sheet, when assembled to the file, has a height somewhat less than the vertical clearance at the open side of the storage space, but sufficiently high to provide a wide spacing between the bonding strips 33 and 35. The depth of the base sheet should be less than the depth of the support plate 12, and the tab 30 should be of a width to overlie the ledge 11, but sufficiently narrow to avoid interference with the cover 17 when it is extended and folded down to cover the file opening.

The present invention is particularly adapted to convert file pockets and file wallets for use in shelf filing. In the illustrated embodiment, the file pocket 20 has front and rear panels of predetermined vertical and horizontal dimensions adapted to stand upright on a shelf so that the bottom edge 41 rests on the shelf and the upper edge is exposed for displaying a top index. The tab assembly 31 has a base sheet which is adapted to overlie a substantial portion of one of the panels of the file, and in the present instance is substantially coextensive in width and height with the rear panel 24 of the file. The base sheet terminates at its upper edge in a fold line 241 to provide a connection between the flap 23 and the base sheet 37 so that a panel of the file may be gripped within the fold and attached to the base sheet along the upper margin of the panel by a first fastening means, preferably the adhesive strips 33 and 39. The lower margin of the panel is also attached to the base sheet along the length of the lower margin preferably by a second adhesive strip 35, so that the second adhesive strip 35 is spaced from and coextensive in length with the first adhesive strips 33 and 39 to afford attachment of the assembly to the file at widely spaced areas. The substantial overlap of the base sheet with a panel of the file provides an effective reinforcement for the file.

The many advantages and novel features of the invention are apparent in view of the foregoing description and accompanying drawings. The conversion of a top-index file to a side-index file rather than purchasing a whole new set of side-index files is very economical. By designing a conversion tab assembly which may be quickly and easily mounted to any horizontal file eliminates the need for purchasing new files or a new type of shelf storage system. In addition, the use of a reinforced side-index file enables the horizontal displacement and removal of a side-index file which is heavy and filled to capacity from a horizontal storage shelf 10 without the risk of breakage of the tab and loss, damage and disorder resulting from the breakage of the tab and the falling of the file and contents. The use of a conversion tab assembly for the conversion of a top-index file to a side-index file yields low cost and durability of the assembly to the consumer while providing an efficient and aesthetic means to store articles in a file.

It will be recognized by those skilled in the art that changes or modifications may be made to the above-described embodiment without departure from the broad inventive concepts of the invention. For example, the conversion tab assembly could be mounted to the front panel 25 of file 20 rather than to the rear panel of the file. Furthermore, the bonding components may be applied at other locations on the sheet and flap member such as at various locations along the contact points between the flap, the sheet and the mounting panel of the file. In addition, a side-index file could be converted to a top-index file in the same manner as in the present invention for use in a vertical storage assembly. Although the accordion-type file 20 is preferred, any form of a file or folder having an opening and a surface suitable for mounting the conversion tab assembly of the present invention thereto may be used with the present invention. It is understood, therefore, that the invention is not limited to the particular embodiment which is disclosed, but is intended to include all modifications and changes which are within the scope and spirit of the invention as defined by the appended claims.

What is claimed is:

1. A conversion tab assembly for application to a file having a panel of predetermined size to enable conversion between a top-index file and a side-index file, the panel being adapted to stand upright to provide a top longitudinal margin and a bottom longitudinal margin, said tab assembly comprising a base sheet having a tab member at one boundary of said base sheet, the base sheet being dimensioned to overlie at least a substantial portion of the panel with said sheet extending along the length of the panel, said sheet having a selected strength of the panel, said sheet having a selected strength and stiffness to enable the file to be displaced using said tab member, a flap member along one edge of said base sheet to permit sandwiching of an element of the file between said base sheet and said flap along one longitudinal margin of the panel to reinforce the converted file, and means to mount said conversion tab assembly to the file with the tab member projecting beyond a side boundary of the file, said mounting means including a first means to affix said flap member to the file panel along the sandwiched margin, and a second means to affix said base sheet to the file, said second means being positioned on said base sheet at a distance from said first means to afford attachment of the assembly to the file at widely-spaced areas.

2. The conversion tab assembly set forth in claim 1, in which said base sheet is dimensioned whereby, upon mounting said tab assembly to the panel of the tile, said one boundary of said base sheet registers with the side boundary of the file panel, and said one edge of said base sheet registers with an edge of the file panel, said base sheet and the file being at least partially coextensive, thereby enabling the displacement of the file using said tab member.

3. The conversion tab assembly set forth in claim 1 wherein said flap is coextensive in length with said base sheet and is joined to said base sheet by a longitudinal fold line, and said first means to affix said flap member comprises a first bonding strip extending along the length of said flap member parallel to said fold line, and a second bonding strip extending along the length of said base sheet parallel to said fold line, in a position such that, upon mounting said tab assembly to the file with said flap member folded over the panel of the file, said bonding strips affix said tab assembly to different surfaces of file panel.

4. The conversion tab assembly set forth in claim 1 including means on said tab member providing indicia to identify the file.

5. The conversion tab assembly set forth in claim 1 wherein said second means to affix said base sheet to the panel comprises a bottom bonding strip extending longitudinally of said base sheet in a position to engage the bottom longitudinal margin of the panel.

6. The assembly as claimed in claim 1 wherein said base sheet has a length not substantially less than the length of the file panel and has a height not substantially less than the height of the file panel.

7. In combination with a top-index file having front and rear panels having tops and bottoms, said bottoms being interconnected to provide a receptacle for receiving and storing file contents between said panels, a conversion tab assemble to convert said top-index file to a side-index file, said assembly comprising a base sheet dimensioned to overlie at least a substantial portion of one of said panels along its length and having a tab member at a side boundary of said base sheet, and means to mount said conversion tab assembly to said file with the tab member projecting beyond the side boundary of said file, the base sheet having a selected strength and stiffness to enable the file to be displaced using said tab member, and a flap member along the top margin of said base sheet to permit sandwiching the top margin of an element of said file between said base sheet and said flap, said mounting means comprising a first bonding component extending along the top of the panel affixing said element both to said flap and to said base sheet, to reinforce said converted file, and a second bonding component extending along the bottom of said panel to anchor the sheet to said panel at widely-spaced areas.

8. The combination of claim 7, in which said base sheet is affixed to one of said panel elements of said file with one boundary of said base sheet registering with the corresponding boundary of said panel element, and said one edge of said base sheet registering with an edge of said panel element, thereby enabling the displacement of the side-index file using said tab member.

9. The combination of claim 8 wherein said boundaries of said base sheet and said panel element are coextensive in height and said tab extends substantially the full height of said coextensive boundaries.

10. The combination of claim 8, in which said file panel sandwiched between said flap and said base sheet is substantially coextensive in length and height with said base sheet, said flap being joined to said base sheet by a fold line, and said first bonding component to mount said tab assembly comprises a first adhesive strip extending along the length of said flap member parallel to said fold line, and a second adhesive strip extending along the length of said base sheet parallel to said fold line, in a position such that with said flap member folded over said panel of said file, said adhesive strips affix said tab assembly to opposite surfaces of said file panel.

11. The combination set forth in claim 8 wherein said file panel elements are interconnected at least partially along said corresponding boundary by accordion-pleated gusset means to form an expandible file pocket.

12. The conversion tab assembly set forth in claim 7 including means on said tab member providing indicia to identify the file.

13. In combination with a shelf structure having a storage space of a selected depth, with an access opening having a selected height and a suitable width to receive files with file panels of predetermined vertical and horizontal dimensions to be positioned within said shelf storage space, a conversion tab assembly for application to a top-index file to enable its conversion to a side-index file, comprising a base sheet dimensioned to overlie at least a substantial portion of one of the file panels and having a tab member at one side boundary of said base sheet, and means to mount said conversion tab assembly to said file with the tab member projecting beyond a side corresponding boundary of said file, the base sheet having a selected strength and stiffness to enable the file to be displaced using said tab member, and a flap member along the top margin of said base sheet to permit sandwiching of the top margin of an element of said file between said base sheet and said flap to reinforce said converted file, said base sheet having a height less than said selected height, and a depth less than said selected depth, said mounting means comprising a first means extending along the entire top margins of the base sheet and flap, and a second means extending along the entire bottom margin of said base sheet to afford attachment of said base sheet to the panel at widely spaced areas along the top and bottom horizontal dimensions of the panel.

14. The combination set forth in claim 13 wherein said shelf structure includes at least one stop ledge positioned along the length of said access opening at the bottom of said opening to confine files positioned within said storage space from sliding out of said space, said tab extending the full height of said primary sheet and having a notch at its bottom to register with said ledge, whereby said tab may project beyond the front of a file positioned in said structure and overlie said stop ledge.

15. The conversion tab assembly set forth in claim 13 including means on said tab member providing indicia to identify the file.

16. The combination of claim 13 in which said flap is connected to said base sheet by a fold line extending along the top edge of the base sheet, including a file positioned in said storage space, said file having front and rear panel elements extending along the depth of said storage space and being interconnected along both side edges with accordion gussets to form an expandible file, said base sheet being substantially coextensive vertically and horizontally with and affixed to one of said panel elements, said one panel element having a free upper edge engaging in said fold line so that the marginal portion of said panel along said upper edge is sandwiched between said base sheet and said flap.

* * * * *

UNITED STATES PATENT AND TRADEMARK OFFICE

CERTIFICATE OF CORRECTION

PATENT NO. : 4,923,217

DATED : May 8, 1990

INVENTOR(S) : Philip B. Pressler

It is certified that error appears in the above-identified patent and that said Letters Patent is hereby corrected as shown below:

Column 6, line 42, delete the entire line: "panel, said sheet having a selected strength of the";

Column 7, line 29, change "assemble" to --assembly--;

Column 8, line 24, after "side" delete "corresponding".

Signed and Sealed this

Thirtieth Day of July, 1991

*Attest:*

*Attesting Officer*

HARRY F. MANBECK, JR.

*Commissioner of Patents and Trademarks*